US005857444A

United States Patent [19]

Kubo et al.

[11] Patent Number: 5,857,444

[45] Date of Patent: Jan. 12, 1999

[54] INNER CAM SYSTEM DISTRIBUTOR TYPE FUEL INJECTOR

[75] Inventors: Kenichi Kubo; Kazuaki Narikiyo; Jun Matsubara, all of Higashimatsuyama, Japan

[73] Assignee: Zexel Corporation, Tokyo, Japan

[21] Appl. No.: 919,361

[22] Filed: Aug. 28, 1997

[30] Foreign Application Priority Data

Aug. 29, 1996 [JP] Japan ..... 8-247105

[51] Int. Cl.[6] ..... F02M 37/04

[52] U.S. Cl. ..... 123/450; 417/462

[58] Field of Search ..... 123/448, 449, 123/450; 417/462

[56] References Cited

U.S. PATENT DOCUMENTS

| | | | |
|---|---|---|---|
| 4,376,432 | 3/1983 | Davis | 123/450 |
| 4,687,425 | 8/1987 | Takano et al. | 417/462 |
| 4,930,998 | 6/1990 | Scott | 417/462 |
| 5,244,354 | 9/1993 | Nicol | 417/462 |
| 5,513,965 | 5/1996 | Nakamura et al. | 123/450 |
| 5,546,906 | 8/1996 | Cooke | 123/450 |

*Primary Examiner*—Thomas N. Moulis

*Attorney, Agent, or Firm*—Wenderoth, Lind & Ponack, L.L.P.

[57] ABSTRACT

A rotor that rotates in synchronization with an engine is provided inside a housing and a cam ring is provided outside and around the rotor so that plungers are caused to move reciprocally in the direction of the radius by the cam ring as the rotor rotates. At both sides of the cam ring, support members (barrel 8, bearing support member 6) constituted of the same material as that of the cam ring are secured to the housing and to both sides of the cam ring, and these support members alone hold the cam ring from both sides rotatably. A connecting rod connecting the cam ring and the timer mechanism is formed as an integrated part of the cam ring. The clearance between the cam ring and the members holding it can be set small so that the vibration of the cam ring is reduced to minimize the impact noise made by the cam ring and wear of the cam ring. In addition, the connection strength between the cam ring and timer mechanism is increased.

8 Claims, 2 Drawing Sheets

INNER CAM SYSTEM DISTRIBUTOR TYPE FUEL INJECTOR

BACKGROUND OF THE INVENTION

1. Field of the Invention

The present invention relates to a distributor type fuel injector employing a system whereby a cam ring with a cam surface (cam lobes) formed on its internal circumference is provided around a rotor to cause plungers provided at the rotor to move reciprocally in a radial direction to vary the volumetric capacity of a compression space.

2. Description of the Related Art

Inner cam system distributor type fuel injectors in the prior art employ a basic structure in which a cam ring with a cam surface (cam lobes) formed on its inner circumference is provided around a rotor, plungers are provided slidably in the direction of the radius of the rotor and the plungers are caused to move reciprocally in the direction of the radius by the cam surface (cam lobes) of the cam ring as the rotor rotates, as disclosed in, for instance, Japanese Unexamined Patent Publication No. S 61-237840 and Japanese Unexamined Patent Publication No. H7-247932. In this basic structure, the cam ring, which is held by a housing, is caused to rotate in the circumferential direction by a timer mechanism provided below it.

While the housing comprising the fuel injector is constituted of an aluminum alloy or the like to achieve a reduction in weight, the cam ring itself is constituted of steel or the like in order to increase the hardness. Because of this, the cam ring may become seized in the housing due to different coefficients of thermal expansion of the various members in cold weather. Therefore, in the structure in the prior art described above, the housing and the cam ring are designed to have sufficient clearance between them to prevent this from happening.

However, in the structure described above, in which the clearance between the housing and cam ring must be set large in consideration of the varying coefficients of thermal expansion in different members, some axial misalignment tends to occur between the cam ring and the rotor, resulting in vibration in the cam ring during operation of the fuel injector. This, in turn, leads to problems such as increased impact noise caused by the cam ring coming in contact with the housing and wear on the contact surfaces of the cam ring and the housing.

In addition, in the prior art technology described above, the cam ring and the timer mechanism are linked together by a separate connecting rod. If the clearance is increased, however, the load on the connecting rod is increased, making it difficult to achieve sufficient connection strength.

SUMMARY OF THE INVENTION

Reflecting the problems discussed above, an object of the present invention is to provide an inner cam system distributor type fuel injector in which the clearance between the cam ring and the members holding it is reduced to achieve a reduction in the volume of impact noise at the cam ring by preventing vibration of the cam ring and to minimize the wear between the cam ring and the housing. Another object of the present invention is to increase the connection strength of the cam ring and the timer mechanism.

The inventor of the present invention has observed that the problems discussed above, which result from the cam ring being held directly by the housing, can be solved by achieving a structure in which the cam ring is held so that the cam ring and the housing do not come into contact with each other by reducing the clearance between the cam ring and its holding members, and has made concentrated research into a practical structure that satisfies these requirements, which culminated in the completion of the present invention.

Namely, in the inner cam system distributor type fuel injector according to the present invention, a rotor that rotates in synchronization with an engine is held within a housing, a cam ring with a cam surface (cam lobes) on its internal circumference is provided around the outside of the rotor and is caused to rotate in the circumferential direction to vary the position of the cam surface (cam lobes) relative to the housing, plungers facing opposite a fuel compression portion formed at the rotor are provided slidably in the direction of the radius of the rotor and the plungers are caused to move reciprocally in the direction of the radius by the cam surface (cam lobes) as the rotor rotates. Support members constituted of the same material as that constituting the cam ring is secured in the housing at the two sides of the cam ring so that the cam ring is held rotatably from both sides by the support members only.

As a structure whereby the support members support the cam ring, connecting projections that project out at both sides along the circumferential edges of the cam ring may be formed at the cam ring to fit the support members inside or outside of the connecting projections. For instance, circular connecting projections or a plurality of connecting projections positioned on the circumference may be provided at the circumferential edges of the cam ring so that the support members can be internally fitted to use the inside of the connecting projections as a sliding surface.

Consequently, since the cam ring is held from both sides only by the support members that are secured at the housing, the cam ring does not come in contact with the housing. Furthermore, since the support members and the cam ring are constituted of the same material, the clearance between the cam ring and the support members remains nearly constant even when there is a change in temperature, making it possible to set the design clearance very small.

It is desirable to constitute the housing of an aluminum alloy in order to achieve lighter weight and to constitute the cam ring and the support members that support the cam ring of either iron or steel to ensure sufficient hardness.

In addition, in a structure in which both sides of the cam ring are held by separate members, as in the present invention, the cam ring can be fitted from the direction of the radius of the rotor. In other words, in the structure in the prior art, since it is necessary that the cam ring be held directly by the housing, a mounting hole for inserting the cam ring from the direction of the radius cannot be provided at the internal circumferential surface of the housing. Because of this, it is necessary to perform assembly by sequentially fitting the support members and the cam ring in the axial direction of the rotor. In contrast, according to the present invention, the cam ring is held by support members which are separate from the housing. Therefore, as long as the support members are securely fixed to the housing, it is not necessary to provide the housing directly around the cam ring and, consequently, no problem arises even if a mounting hole is formed in the housing for fitting the cam ring from the direction of the radius.

Thus, the connecting rod that connects the cam ring to the timer mechanism may be formed as an integrated part of the cam ring. In other words, as long as the cam ring can be fitted from the direction of the radius, no hindrance to assembly work of the cam ring exists, even if the connecting rod, previously assembled as a separate member, is formed as an integrated part of the cam ring. Rather, by forming the connecting rod as an integrated part of the cam ring, the strength of the connecting rod can be improved and, moreover, play between the connecting rod and the cam ring, which may occur if the connecting rod is provided as a separate member, can be eliminated.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENT

Figure 1:
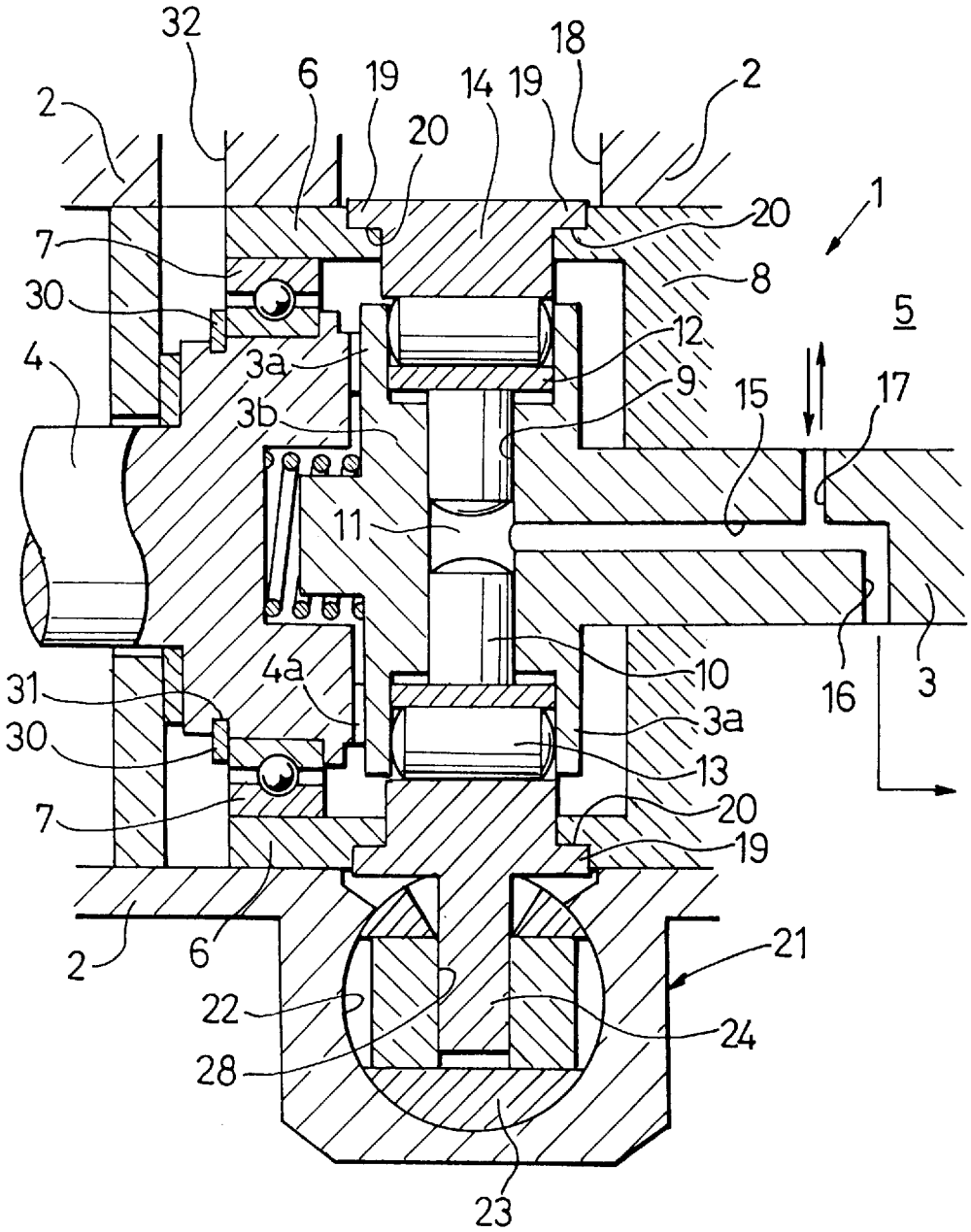
FIG. 1 is a cross section of the cam ring which constitutes the essential portion of the distributor type fuel injector according to the present invention and of its periphery.
Figure 2:
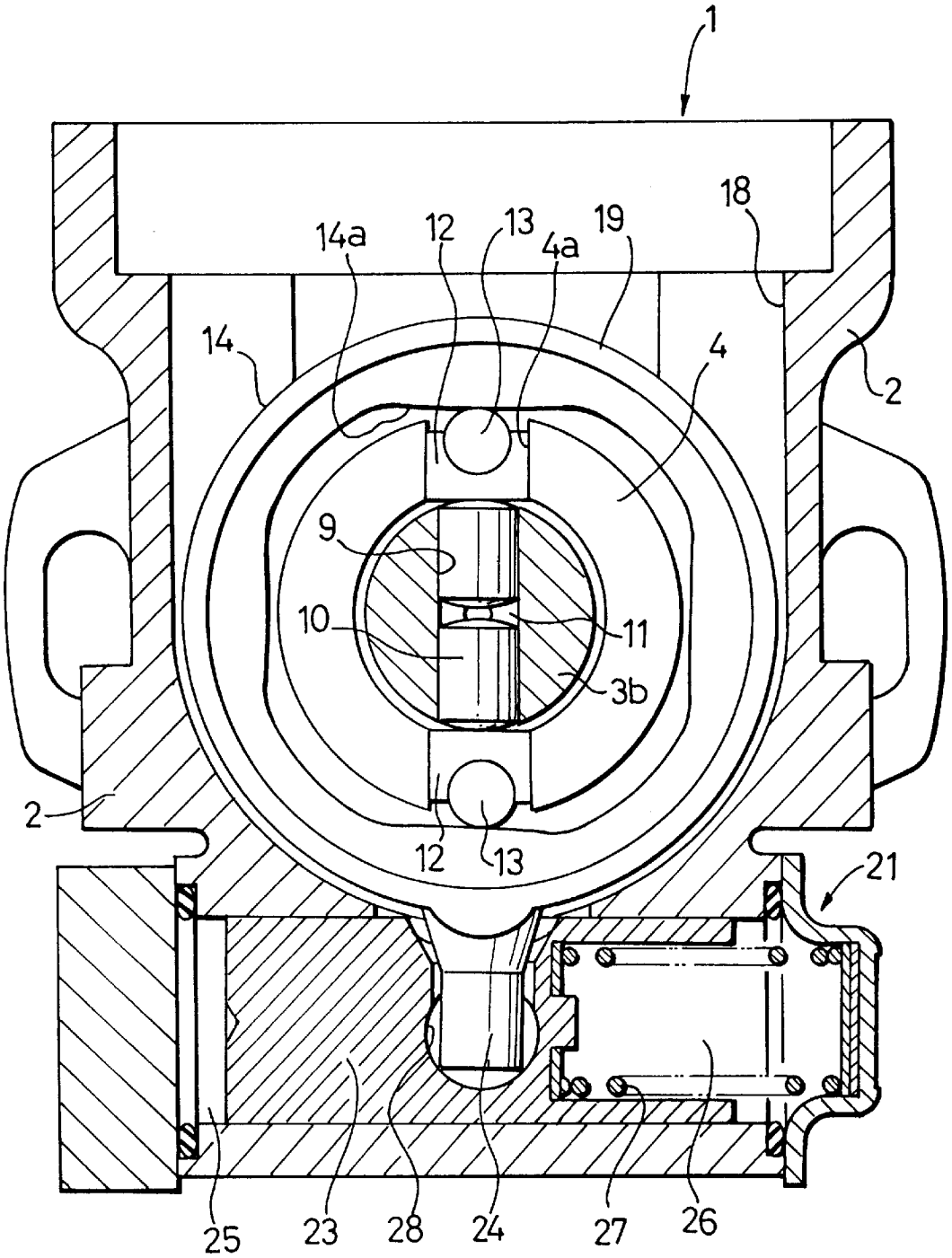
FIG. 2 is a cross section through FIG. 1 exposing the end surface of the cam ring.

The following is an explanation of an embodiment of the present invention in reference to the drawings. In FIGS. 1 and 2, which show the essential structure of the inner cam system distributor type fuel injector, a fuel injector 1 is provided with a rotor 3 inside a housing 2. The rotor 3, upon receiving drive torque from an engine (not shown) via a drive shaft 4, rotates in synchronization with the engine. The rotor 3 extends through a chamber 5, which is delimited by the housing 2, and fuel from a fuel tank is supplied via a feed pump (not shown) to the chamber 5.

The drive shaft 4 is mounted rotatably at a bearing support member 6 which is secured at the housing 2 via a radial bearing 7. A spring washer 30, which holds the radial bearing 7 to ensure that it does not become misaligned in the axial direction of the shaft, is fitted in a circular groove 31 at the circumferential surface of the drive shaft 4 and this spring washer 30 determines the positions of the radial bearing 7 and the bearing support member 6 relative to the housing 2.

The rotor 3 is inserted in and supported rotatably by a barrel 8 or the like which is secured at the housing 2 and receives a rotatory motive force with projecting portions 3*a* projecting out in the direction of the radius and fitted in a groove 4*a* extending in the direction of the radius formed at the connecting end portion of the drive shaft 4. The projecting portions 3*a* formed at the rotor 3 is formed as an integrated part of the greater diameter portion 3*b*, which is formed by increasing the diameter at the connecting end portion, and plunger passages 9 extending in the direction of the radius (radial direction) are formed at the greater diameter portion 3*b*. In this structural example, two plunger passages 9 are formed at 180 degree intervals on the same plane and plungers 10 are slidably inserted in each plunger passage 9.

The front end of each plunger 10 faces a compression space 11 provided at the center of the rotor 3, blocking it off. The base end of the plunger 10 slides in contact against the internal surface of the cam ring 14 via a shoe 12 and a roller 13 provided between projecting portions 3*a*. The cam ring 14 is provided coaxially around the outside of the rotor 3 and has cam lobes 14A, the number of which corresponds to the number of cylinders, on its internal circumference so that when the rotor 3 rotates, each plunger 10 moves reciprocally in the direction of the radius (radial direction) of the rotor 3 to vary the volumetric capacity of the compression space 11.

In other words, the cam ring 14 is provided with cam lobes 14A formed at 90° intervals on the inside if the cam ring 14 to correspond to a 4-cylinder engine. Consequently, two plungers 10 simultaneously move in such a manner that they reduce the compression space 11 for compression and then simultaneously move away from the compression space.

At the rotor 3, a longitudinal hole 15, which communicates with the compression space 11, is formed in the axial direction of the rotor 3 and at this longitudinal hole 15, a distribution port 16 that communicates sequentially with a plurality of distribution passages (not shown), the number of which corresponds to the number of cylinders, and an inflow/outflow port 17 that is capable of opening into the chamber 5, are formed.

It is to be noted that a delivery valve is provided in each distribution passage and that compressed fuel is force-fed from these delivery valves to the injection nozzles. In addition, at the portion of the rotor 3 that is exposed to the chamber 5, an open/close mechanism that opens the inflow/outflow port 17 to the chamber 5 to guide the fuel in the chamber to the compression space 11 during the intake process and closes the inflow/out flow port 17 during an early period of the force-feed process and opens the inflow/outflow port 17 to the chamber 5 to cut off the force-feed of fuel during the latter period of the force-feed process is provided.

The cam ring 14 is inserted through a mounting hole 18 formed at the upper portion of the housing 2 with circular connecting projections 19 projecting out in the direction of the axis formed at both sides thereof, and is externally fitted slidably on a circular staged portion 20 formed at the circumferential edge of the barrel 8 and the bearing support member 6.

The barrel 8 and the bearing support member 6 are constituted of the same material, such as iron, as that constituting the cam ring 14, and the clearance between them is set so that no play exists and that smooth sliding of the cam ring 14 is assured. In addition, an opening 32 that opens facing the spring washer 30 and into which assembly tools and the like can be inserted is formed in the upper portion of the housing 2.

Under the cam ring 14, a timer mechanism 21 is provided, having a timer piston 23 slidably stored in a cylinder 22 that is formed in the housing 2, and a connecting rod 24, which is formed as an integrated part of the cam ring 14, is inserted in a connecting hole 28 of the timer piston 23 from the direction of the radius (from above) so that the linear movement of the timer piston 23 is converted to a rotary movement of the cam ring 14 to adjust the injection timing in correspondence to the operating conditions of the engine.

In addition, at one end of the timer piston 23, a high pressure chamber 25 is formed, into which the fuel in the chamber 5 is guided, and at the other end, a low pressure chamber 26 is formed, communicating with the intake path of the feed pump. In the low pressure chamber 26, a timer spring 27 is provided to apply a constant force to the timer piston 23 toward the high pressure chamber. Consequently, the timer piston 23 stops at a position where the spring force imparted by the timer spring 27 and the pressure in the high pressure chamber are in balance. When the pressure in the high pressure chamber rises, the timer piston 23 moves toward the low pressure chamber against the force of the timer spring 27 to cause the cam ring 14 to rotate in the direction in which the injection timing is advanced, whereas when the pressure in the high pressure chamber is reduced, the timer piston 23 moves toward the high pressure chamber, causing the cam ring to rotate in the direction in which the injection timing is retarded. It is to be noted that the pressure in the high pressure chamber is adjusted by a timing control valve (not shown) so that the desired timing advance angle is achieved.

In the structure described above, the opening into which members to be provided inside the housing are assembled is formed at the right hand side in FIG. 1, and they are assembled by following the procedure described below. First, the spring washer 30, the bearing support member 6 and the radial bearing 7 are inserted into the housing 2 from the right hand side of the housing 2 in the figure. At this point, the drive shaft 4 has not yet been inserted and the positions of the inserted spring washer 30 and the like have not yet been determined.

Then, with the bearing support member 6 pressed to the left in the figure to ensure that it does not block the mounting hole 18, the cam ring 14 is fitted in through the mounting hole 18 in the housing 2 with the connecting rod 24 turned downward and the connecting rod 24 is inserted in a connecting hole 28 of the timer piston 23.

Then, with the cam ring inserted, the drive shaft is inserted passing through the inside of the cam ring from the right hand side in the figure. At the same time, a mounting tool is inserted via the opening portion 32 to spread the spring washer 30 and fit it into the circular groove 31 at the circumferential surface of the drive shaft. Through this assembly work, the positions of the bearing support member 6 and the radial bearing 7 are determined relative to the position of the housing 2, and the bearing support member 6 becomes connected with one of the connecting projections 19 of the cam ring 14.

After this, the rotor 3 and the barrel 8 are inserted into the housing 2 along with the rollers 13 and the like from the right hand side in the figure, and the projecting portions 3*a* at the bottom end of the rotor are fitted in the groove 4*a* of the drive shaft 4. In addition, the barrel 8 is mounted to become internally fitted to the other connecting projection 19 of the cam ring 14. Ultimately, as shown in FIG. 1, the connecting projections 19 at both sides of the cam ring 14 are externally fitted to the circular staged portions 20 of the bearing support member 6 and the barrel 8 to support the cam ring 14 rotatably from both sides to complete the assembly.

Consequently, since the cam ring 14 is supported rotatably from both sides by members (the barrel 8, the bearing support member 6) that are provided separately from the housing 2, without coming in contact with the housing 2, the cam ring 14 rotates by sliding against the staged portions 20 of the members at both sides when the timer piston 23 moves. With this, since the barrel 8 and the bearing support member 6 are constituted of the same material as that of the cam ring 14 and their coefficients of thermal expansion are, therefore, the same, the clearance between the individual staged portions 20 and the connecting projections 19 of the cam ring 14 remains practically constant in cold weather and do not, therefore, adversely affect the rotation of the cam ring 14, even with the clearance set very small.

In addition, since the cam ring is held from both sides by members that are provided separately from the housing 2 and the cam ring 14 can be mounted in the housing 2 via the mounting hole 18, as explained earlier, no problem arises even if the connecting rod 24 connecting the cam ring 14 and the timer mechanism 21 is formed as an integrated part of the cam ring 14 and through such integrated formation, the strength of the connecting rod 24 can be improved while also eliminating play in the connecting rod 24.

It is to be noted that the connecting projections 19 formed at the circumferential edges of the cam ring 14 do not necessarily have to be formed in a circular shape as in the case described above, and it is obvious that, as long as the structure allows it to be fitted slidably with the barrel 8 and the bearing support member 6, advantages similar to those described above will be achieved with a portion of the circular shape notched or with a plurality of projections provided on the circumference.

As has been explained, according to the present invention, since the support members, which are constituted of the same material as that of the cam ring, are secured to the housing at both sides of the cam ring and the cam ring is held rotatably from both sides by the support members only, it is possible to set the clearance between the cam ring and the support members very small, to reduce abnormal noise and wear of the cam ring resulting from play at the cam ring. Furthermore, since the clearance can be reduced, the axes of the cam ring and the rotor are less likely to become misaligned, assuring stable and smooth operation of the cam ring.

In addition, since a structure in which the cam ring is held from both sides by support members secured to the housing rather than directly holding the cam ring by the housing itself is achieved, it is possible to mount the cam ring at a specific position from the direction of its radius.

Consequently, it becomes possible to form the connecting rod that connects the cam ring and the timer mechanism as an integrated part of the cam ring to increase the connection strength of the cam ring and the timer mechanism and to reduce play compared to the structure in the prior art, in which the connecting rod is provided as a separate member from the cam ring.

What is claimed is:

1. An inner cam system distributor type fuel injector comprising:

a housing;

a rotor held inside said housing, to rotate in synchronization with an engine;

a cam ring provided outside said rotor, having a cam surface on an internal circumference thereof, to vary the position of said cam surface relative to said housing by rotating in the direction of the circumference thereof;

plungers facing a fuel compression portion formed at said rotor and provided slidably in the direction of the radius of said rotor to be caused to move reciprocally in said direction of said radius by said cam surface as said rotor rotates; and support members constituted of the same material as that constituting said cam ring and secured to said housing at both sides of said cam ring;

wherein:

said cam ring is held rotatably from both sides by said support members only.

2. An inner cam system distributor type fuiel injector according to claim 1, wherein:

connecting projections projecting out to both sides along circumferential edges of said cam ring are formed at said cam ring to fit said support members on the inside or the outside of said connecting projections.

3. An inner cam system distributor type fuel injector according to claim 2, wherein:

circular connecting projections are provided at circumferential edges of said cam ring to internally fit said support members making the inner sides of said connecting projections sliding surfaces.

4. An inner cam system distributor type fuel injector according to claim 1, wherein:

said housing is constituted of an aluminum alloy and said cam ring and said support members are constituted of a material with greater hardness than the material constituting said housing.

5. An inner cam system distributor type fuel injector according to claim 1, wherein:

a mounting hole through which said cam ring is inserted into said housing from the direction of the radius thereof is formed at said housing and said cam ring is held by said support members while inserted from said mounting hole.

6. An inner cam system distributor type fuel injector according to claim 1, wherein:

a timer mechanism that causes said cam ring to rotate in the circumferential direction thereof is provided below said cam ring and a connecting rod connecting said cam ring and said timer mechanism is formed as an integrated part of said cam ring.

7. An inner cam system distributor type fuel injector according to claim 1, wherein:

said cam ring is provided with cam lobes, the number of which corresponds to the number of cylinders, on an inner circumferential surface thereof and an even number of plungers that are provided facing opposite each other at said rotor move reciprocally in the direction of the radius.

8. An inner cam system distributor type fuel injector comprising:

a housing provided with a mounting hole at a side thereof;

a rotor held inside said housing and rotates by connecting with a drive shaft;

a cam ring provided outside said rotor, having a cam surface on an internal circumference thereof to vary the position of said cam surface relative to said housing by rotating in a circumferential direction thereof;

plungers facing a fuel compression portion formed at said rotor and provided slidably in the direction of the radius of said rotor, to be caused to move reciprocally in said direction of said radius by said cam surface as said rotor rotates; and support members constituted of the same material as that constituting said cam ring and secured to said housing at both sides of said cam ring;

wherein:

one of said support members is inserted into said housing from an axial direction of said rotor;

said cam ring is then inserted into said housing via said mounting hole;

said drive shaft is then mounted passing through said cam ring from said axial direction;

the other of said support members and said rotor are inserted from said axial direction to;

connect said rotor and said drive shaft so that said cam ring is held rotatably by said support members at both sides.

* * * * *